US008143795B2

(12) United States Patent
Breuer et al.

(10) Patent No.: US 8,143,795 B2
(45) Date of Patent: Mar. 27, 2012

(54) CIRCUIT ARRANGEMENT FOR FIRING A DISCHARGE LAMP

(75) Inventors: Christian Breuer, Newburyport, MA (US); Martin Brückel, Garching (DE); Andreas Huber, Maisach (DE); Ralf Hying, München (DE); Bernhard Reiter, München (DE)

(73) Assignee: Osram AG, Munich (DE)

( * ) Notice: Subject to any disclaimer, the term of this patent is extended or adjusted under 35 U.S.C. 154(b) by 258 days.

(21) Appl. No.: 12/312,490

(22) PCT Filed: Nov. 9, 2006

(86) PCT No.: PCT/EP2006/068302

§ 371 (c)(1),
(2), (4) Date: May 11, 2009

(87) PCT Pub. No.: WO2008/055547

PCT Pub. Date: May 15, 2008

(65) Prior Publication Data

US 2010/0045196 A1 Feb. 25, 2010

(51) Int. Cl.
*H05B 41/04* (2006.01)

(52) U.S. Cl. ..... 315/224; 315/209 R; 315/291; 315/307; 315/311

(58) Field of Classification Search ..... 315/209 R, 315/224, 246, 247, 291, 307, 311
See application file for complete search history.

(56) References Cited

U.S. PATENT DOCUMENTS

| | | | | |
|---|---|---|---|---|
| 4,471,269 | A * | 9/1984 | Ganser et al. | 315/307 |
| 4,949,016 | A * | 8/1990 | De Bijl et al. | 315/208 |
| 5,932,976 | A * | 8/1999 | Maheshwari et al. | 315/291 |
| 6,020,691 | A * | 2/2000 | Sun et al. | 315/307 |
| 6,177,768 | B1 * | 1/2001 | Kamata et al. | 315/241 R |
| 6,380,694 | B1 * | 4/2002 | Uchihashi et al. | 315/244 |
| 6,426,597 | B2 * | 7/2002 | Rast et al. | 315/219 |
| 7,504,782 | B2 * | 3/2009 | Hasegawa et al. | 315/307 |
| 2004/0183463 | A1 | 9/2004 | Sun et al. | |
| 2006/0055345 | A1 | 3/2006 | Takeuchi | |

FOREIGN PATENT DOCUMENTS

| | | | |
|---|---|---|---|
| CN | 1034296 | A | 7/1989 |
| JP | 2000-152296 | A | 5/2000 |
| JP | 2003-217888 | A | 7/2003 |
| JP | 2004-095334 | A | 3/2004 |
| JP | 2006-085905 | A | 3/2006 |
| WO | WO 03/039206 | A | 5/2003 |

* cited by examiner

*Primary Examiner* — Douglas W Owens
*Assistant Examiner* — Thai Pham
(74) *Attorney, Agent, or Firm* — Cozen O'Connor

(57) ABSTRACT

A circuit arrangement for starting a discharge lamp, comprising: a first and a second input terminal for connecting an input voltage; an inverter, which has an input and an output, the input being coupled to the first and the second input terminal; a first and a second output terminal for connecting the discharge lamp; a resonant inductor, which is coupled between the output of the inverter and the first output terminal; a resonant circuit, which comprises the resonant inductor; a regulating apparatus for regulating the frequency of the signal provided at the inverter output; and a current measuring apparatus, which is arranged so as to measure a current which is correlated with the current in the resonant circuit, wherein the regulating apparatus is adapted to regulate the frequency at the output of the inverter as a function of the measured current.

12 Claims, 2 Drawing Sheets

CIRCUIT ARRANGEMENT FOR FIRING A DISCHARGE LAMP

RELATED APPLICATIONS

This is a U.S. national stage of application No. PCT/EP2006/068302, filed on Nov. 9, 2006.

FIELD OF THE INVENTION

The present invention relates to a circuit arrangement for starting a discharge lamp with a first and a second input terminal for connecting an input voltage, an inverter, which has an input and an output, the input being coupled to the first and the second input terminal, a first and a second output terminal for connecting a discharge lamp, a resonant inductor, which is coupled between the output of the inverter and the first output terminal, a resonant circuit, which comprises the resonant inductor, and a regulating apparatus for regulating the frequency of the signal provided at the inverter output. The invention moreover relates to a method for starting a discharge lamp using such a circuit arrangement.

BACKGROUND OF THE INVENTION

The present invention generally relates to the problem of the generation of a voltage which is high enough for starting a discharge lamp by means of excitation of a resonant circuit in the region of its resonant frequency. In the prior art, in this case in particular the output voltage of the resonant circuit is measured or is swept over the entire range of resonant frequencies which is possible as a result of tolerances, i.e. alternately from lower to higher frequencies and then from higher to lower frequencies etc. In the case of the first procedure, in this case the output voltage of the resonant circuit is measured, in particular using a voltage divider, in order thereby to select the suitable excitation frequency for the resonant circuit. If it is assumed that the starting voltage is in the region of several kV, the elements of the voltage divider need to be designed for this high voltage. Moreover, the measurement of the output voltage requires a considerable amount of complexity in terms of additionally required components, which is reflected in undesirably high costs. Since the voltage at the output of the resonant circuit is present as an AC voltage owing to the inverter, it is necessary to provide a filter during measurement of said voltage in order to eliminate the AC component, with this filter resulting in additional complexity in terms of components and fitting. In the second variant, i.e. in the case of sweeping, fewer components are required, but sweeping the entire range of possible resonant frequencies which are subject to tolerances results in a low mean output voltage and therefore in the starting conditions being impaired.

SUMMARY OF THE INVENTION

One object of the present invention is to provide the circuit arrangement mentioned at the outset or the method mentioned at the outset in such a way that regulation to the resonant frequency of the resonant circuit for starting a discharge lamp is made possible with less cost expenditure.

The present invention recognizes that more cost-effective regulation to the resonant frequency of the resonant circuit is made possible if the current flowing in the resonant circuit is measured instead of a measurement of the output voltage of the resonant circuit. This can firstly make the provision of a voltage divider designed for high voltages unnecessary. This is because the current measurement takes place by means of a low-resistance shunt resistor, which is coupled in series into the circuit. The voltage across the shunt resistor is generally less than 1 V. In this case, a further circumstance secondly comes in useful: such a shunt resistor for current measurement is in any case provided in electronic ballasts for operating a discharge lamp, i.e. for regulating various operational parameters during permanent operation of the discharge lamp, and, in accordance with the present invention, can now also be used in the regulation in connection with the starting of the discharge lamp.

Additionally, reference is made to the fact that, in the context of the present invention, excitation can also take place at an odd fraction of the resonant frequency, in addition to excitation at the full resonant frequency, as a result of which the requirements placed on the switching speed of the electronic switches of the inverter can be reduced.

In a preferred embodiment, the circuit arrangement furthermore has a voltage transformer, which is coupled between the first and the second input terminal and the input of the inverter, the current measuring apparatus being in the form of a shunt and being arranged in the voltage transformer, and the voltage transformer being connected to a reference potential in such a way that the current through the shunt is correlated with the current in the resonant circuit. In comparison with an arrangement of the shunt resistor in the resonant circuit, this procedure provides the advantage that there is no longer any need for a complex potential-free measurement there.

Preferably, the regulating apparatus comprises a first memory apparatus for storing a value which has been correlated with a maximum of the current in the resonant circuit, a comparison apparatus for comparing a value, which has been correlated with the current in the resonant circuit and which results given the instantaneous frequency of the signal at the output of the inverter, with the maximum stored in the first memory apparatus, and a writing apparatus, which is designed, for the case in which the value, which has been correlated with the current in the resonant circuit and which results given the instantaneous frequency of the signal at the output of the inverter, is greater than the previously input maximum, to input this value into the first memory apparatus.

This measure provides the advantage that a present value for the current (or a variable correlated therewith), which value is optimal for the present circuit arrangement taking into consideration the present ambient conditions, is always used as the controlled variable in the resonant circuit of the circuit arrangement in the regulation to the resonant frequency, irrespective of tolerances or changes owing to temperature dependencies or the like.

In a preferred development, the regulating apparatus furthermore comprises a control apparatus for controlling the frequency of the signal at the output of the inverter, a second memory apparatus, into which a differential value is input, the comparison apparatus furthermore being designed to form the difference between the maximum stored in the first memory apparatus and the value which results given the instantaneous frequency of the signal at the output of the inverter and to compare this with the differential value input in the second memory apparatus, the control apparatus furthermore being designed to alter in one direction, i.e. to lower or to raise, the frequency of the signal at the output of the inverter until the difference is greater than or greater than or equal to the input differential value, and then to alter said frequency again in the reverse direction, i.e. to raise it or to lower it, until the difference is again greater than or equal to the input differential value.

In a procedure which is known from the prior art and is used in the regulation to the output voltage of the resonant circuit, sweeping takes place to a range of +/−5 to +/−10% around the actual resonant frequency in order to find the resonant frequency which is subject to tolerances. Tolerances of the resonant frequency result depending on changing ambient conditions and as a result of component tolerances. In the present invention, the range of the resonant frequency is likewise swept, by way of the definition of the differential value input in the second memory apparatus, but as a consequence of the maximum concomitantly recorded, effects of tolerances and different temperatures on the maximum output voltage and the resonant frequency become unimportant, and so the frequency range around the resonant frequency can be substantially more narrowly defined around the resonant frequency than in the prior art. This results in a substantial increase in the average output voltage of the resonant circuit compared with the procedure known from the prior art. This enables a substantial improvement in the tendency of the connected discharge lamp to start.

Moreover, the preferred embodiment last presented provides a suitable means for eliminating the influence of noise in the detection of a signal correlated with the current of the resonant circuit. This noise can be, for example, of the order of magnitude of 1 to 5% of the useful signal. Another control algorithm, known from the prior art in connection with the voltage measurement, would already reverse the continuing increase in frequency or the continuing lowering of the frequency whenever it measures a lower value after passing through a maximum. This procedure would not take account of the influence of the noise, and would keep preventing the actual maximum from being reached, the result of which would be a smaller voltage/time integral than in the case of the present invention. By also recording the present current maximum (or a value correlated therewith) and dimensioning the differential value such that the contribution of the noise is reliably covered, the frequency range in which sweeping occurs can be minimized, and thus the voltage/time integral can be maximized. The latter results in an optimization of the starting tendency of the discharge lamp connected to a circuit arrangement according to the invention.

In a preferred embodiment of a circuit arrangement according to the invention, in this case the differential value is a maximum of 50% of the maximum, preferably between 5 and 30% of the maximum. In this case, once the maximum has been changed during the starting operation as mentioned, the differential value can also be fixed on the basis of a mean value of the maximum obtained from experience.

The frequency at the output of the inverter is preferably altered in step changes of at most 1 kHz, preferably at most 50 Hz. The time constant of the regulating apparatus is preferably at most 5 ms, more preferably at most 2 ms.

The preferred embodiments described in relation to the circuit arrangement according to the invention and the advantages thereof apply, where appropriate, to the method according to the invention as well.

A particularly preferred embodiment of the method according to the invention has the following steps: a) measurement of the instantaneous current value which results given the instantaneous frequency; b) determination of a difference between a stored current value, which corresponds to a present maximum of the current value, and the instantaneous current value; b1) if the regulation runs straight from higher frequencies to lower frequencies: b11) if the difference is less than a stored differential value: lowering of the instantaneous frequency by a predeterminable frequency value; b12) if the difference is greater than or equal to a stored differential value: raising of the instantaneous frequency by a predeterminable frequency value; b2) if the regulation runs straight from lower frequencies to higher frequencies: b21) if the difference is less than a stored differential value: raising of the instantaneous frequency by a predeterminable frequency value; b22) if the difference is greater than or equal to a stored differential value: lowering of the instantaneous frequency by a predeterminable frequency value; c) comparison of the instantaneous current value with the current value stored as the present maximum: c1) if the instantaneous current value is greater than the stored current value: storing of the instantaneous current value instead of the previously stored current value; c2) if the instantaneous current value is less than the stored current value: cancelling of the instantaneous current value; d) repetition of steps a), b) and c) up until starting of the discharge lamp.

In the present invention, instead of the respective current values, voltage values correlated therewith can readily be measured, evaluated and stored, for example the voltage drop across the shunt.

Further advantageous embodiments are given in the dependent claims.

BRIEF DESCRIPTION OF THE DRAWING(S)

An exemplary embodiment of a circuit arrangement according to the invention will now be described in more detail below with reference to the attached drawings, in which.

PREFERRED EMBODIMENT OF THE INVENTION

Figure 1:
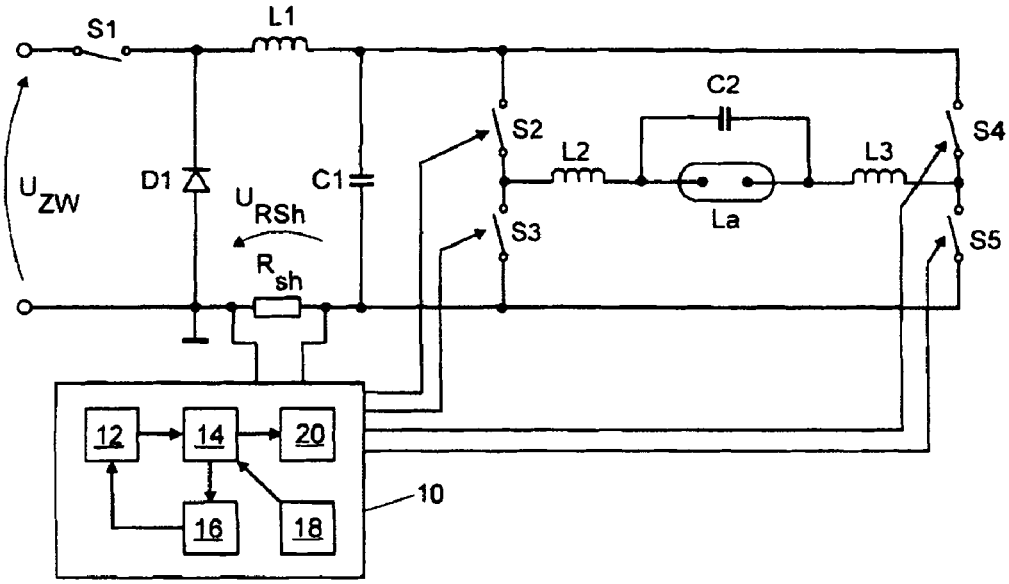
FIG. 1 shows a schematic illustration of a circuit diagram of an exemplary embodiment of a circuit arrangement according to the invention.

FIG. 1 shows a schematic illustration of an exemplary embodiment of a circuit arrangement according to the invention. The so-called intermediate circuit voltage $U_{zw}$, which generally represents a DC voltage of a few hundred V, is present at the input of said circuit arrangement. There then follows a voltage transformer, which in this case is in the form of a step-down converter, for example, and comprises a switch S1, an inductance L1, a diode D1 and a capacitor C1. There then follows an inverter, which in this case is in the form of a full-bridge arrangement, for example, and comprises the switches S2, S3, S4 and S5. The discharge lamp La is coupled via a resonant circuit to the output of the inverter, the resonant circuit comprising the inductances L2, L3 and the capacitor C2. The circuit arrangement furthermore comprises a regulating apparatus 10, to which the voltage drop $U_{RSh}$ across a shunt resistor $R_{Sh}$ arranged in the voltage transformer is supplied. It has four outputs in order to control the switches S2, S3, S4, S5, as is indicated by the arrows. A first memory apparatus 12, a comparison apparatus 14, a writing apparatus 16, a second memory apparatus 18 and a control apparatus 20 are provided in the regulating apparatus 10, with more details being given of these elements in connection with FIG. 3.

The current in the resonant circuit flows, at the time at which the switches S2 and S5 are closed, through the sequence of the elements S2, L2, C2, L3, S5, $R_{Sh}$. At the time at which the switches S3 and S4 are closed, the current flows through the sequence of elements S4, L3, C2, L2, S3, $R_{Sh}$.

Figure 2:
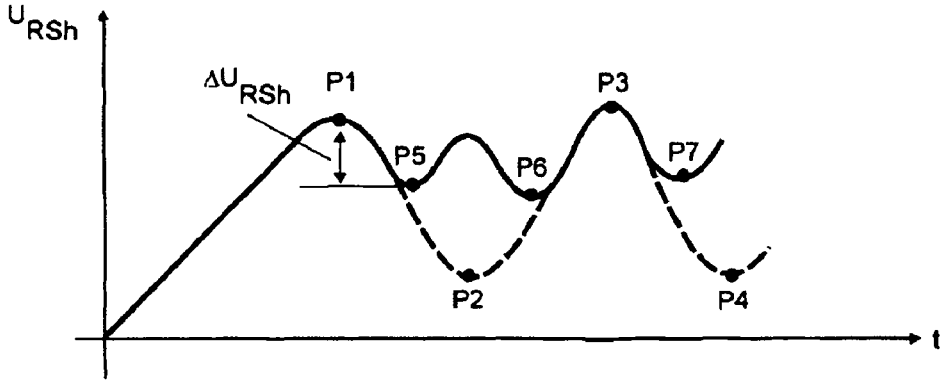
FIG. 2 shows a schematic illustration of the time profile of the voltage across the shunt resistor for the procedure in accordance with the prior art (dashed line) and for the procedure in accordance with the invention (continuous line)

FIG. 2 shows the time profile of the voltage $U_{RSh}$, which has been correlated with the current in the resonant circuit. The dashed line illustrates the profile which would result if a frequency range were to be swept continuously which is fixed in such a way that the maximum is reliably reached taking into consideration noise, tolerance-dependent fluctuations and as a result of temperature dependencies. At point P1, a signal with the resonant frequency $f_{res}$ of the resonant circuit is provided at the output of the inverter. From point P1 to point P2, the frequency is lowered, for example, the maximum extent of lowering by a predetermined percentage value, for example 10%, being reached at point P2. At point P2, the frequency of the signal at the output of the inverter is accordingly 0.9 $f_{res}$. From point P2 onwards, once the mentioned minimum frequency has been reached, the frequency is continuously raised, with the resonant frequency $f_{res}$ again being reached at point P3. Raising the frequency further ultimately leads to point P4, at which the resonant frequency has been overshot by a predetermined amount, for example 10%. At point P4, the frequency is accordingly 1.1 $f_{res}$. From point P4 onwards, the frequency is lowered again, etc.

Figure 3:
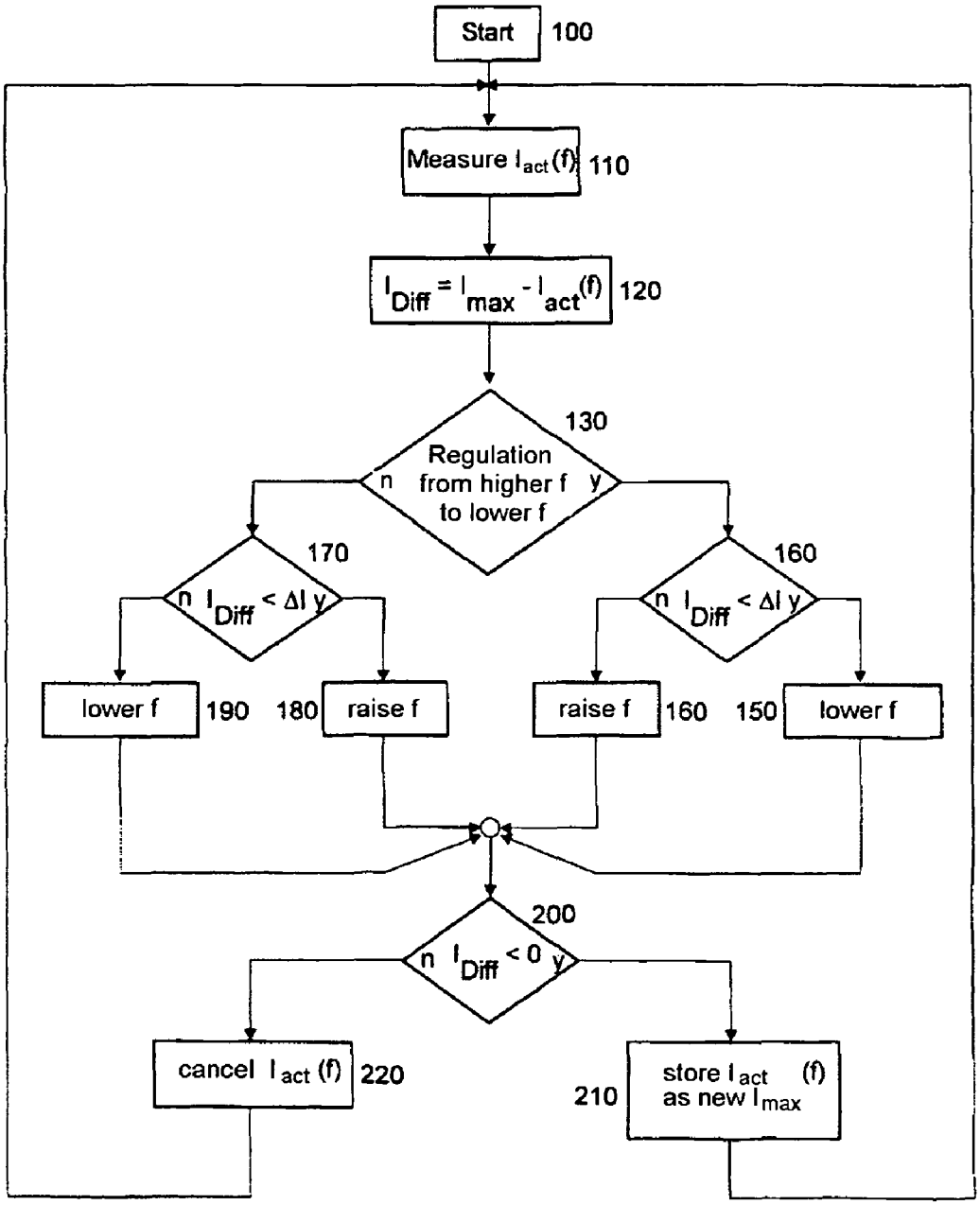
FIG. 3 shows a signal flowchart which illustrates the procedure for the method according to the invention.

We will return to the continuous curve which arises for a circuit arrangement according to the invention after discussion of FIG. 3.

FIG. 3 shows a schematic illustration of a signal flowchart for the method according to the invention. Although the value of the current of the resonant circuit is measured and evaluated in the signal flowchart in FIG. 3, it is also possible for other current values, in particular even voltage values, to be measured, evaluated and stored instead of the current values in the context of the present invention, as is obvious to a person skilled in the art, with these voltage values having been correlated with the current in the resonant circuit.

First, the method according to the invention is started in step 100. In step 110, the present value $I_{act}(f)$ of the current in the resonant circuit is measured as a function of the present frequency. With reference to the exemplary embodiment illustrated in FIG. 1 and FIG. 2, this corresponds to the determination of the voltage $U_{RSh}$ across the shunt resistor $R_{Sh}$ by the regulating apparatus 10. Then, in step 120, the difference between the maximum value $I_{max}$ of the current in the resonant circuit stored in the first memory apparatus 12 and the value $I_{act}(f)$ which results given the instantaneous frequency of the signal at the output of the inverter is formed in the comparison apparatus. In the exemplary embodiment shown in FIGS. 1 and 2, the maximum of the voltage $U_{RSh}$ is stored in the first memory apparatus 12.

It is decisive for the following measures whether the regulation moves straight from higher frequencies to lower frequencies, or vice versa. This is checked in step 130. If the regulation moves straight from higher frequencies to lower frequencies, in step 140 the previously determined difference $I_{Diff}$ is compared with a differential value ΔI stored in the second memory apparatus 18. If the comparison shows that $I_{Diff}$ is less than ΔI, in step 150 the control apparatus 20 is instructed to lower the frequency by a predetermined frequency step Δf. If, however, $I_{Diff}$ is greater than ΔI, in step 160 the control apparatus 20 is instructed to raise the frequency by Δf.

If, however, it is established in step 130 that the regulation runs straight from lower frequencies to higher frequencies, a check is again carried out in step 170 to ascertain whether $I_{Diff}$ is less than ΔI. If this is the case, in step 180 the frequency is raised by Δf. If the check in step 170 gives the result No, in step 190 the frequency is lowered by Δf. As is obvious to a person skilled in the art, the sequence of the steps 130 and 160 or 170 could of course be swapped over in order to achieve the same result.

Then, in step 200, in order to determine whether a new maximum value needs to be stored in the first memory apparatus 12, a check is carried out to ascertain whether the difference $I_{Diff}$ is less than zero. If this is the case, in step 210 the current value $I_{act}(f)$ resulting given the instantaneous frequency is stored as the new value $I_{max}$ in the first memory apparatus 12. If $I_{Diff}$ is greater than zero, there is no new maximum, as a result of which the present value $I_{act}(f)$ is cancelled in step 220. Then, the method for measuring the value $I_{act}(f)$ resulting given the changed frequency returns to step 110. These steps are repeated up until the starting of the discharge lamp. As is obvious to a person skilled in the art, steps 130 to 190 and 200 to 220 can also be implemented in parallel.

Returning to FIG. 2, the continuous curve now shows the time profile of the voltage $U_{RSh}$ for a circuit arrangement according to the invention. In this case, points P5, P6 and P7 denote the reversal points during sweeping of the frequency. In the present example, it has been mentioned with reference to the dashed curve illustrated in FIG. 2 relating to the prior art that the frequency has been lowered from P1 to P2. Then, P5 indicates the point from which the frequency is already raised again in the procedure in accordance with the present invention and, once a local maximum of the voltage $U_{RSh}$ across the shunt resistor $R_{Sh}$ has been passed, is lowered again at point P6. From point P7 onwards, the frequency is raised again according to this.

At points P5, P6 and P7, the value of the differential value stored in the second memory apparatus 18 is accordingly reached by the difference between the maximum stored in the first memory apparatus 12 and the present value, and therefore a reversal of the sweeping operation is triggered. As can clearly be seen, in the curve in accordance with the present invention the actually reached minima differ from one another since they are always less than the preceding maximum by the same value $\Delta U_{RSh}$ stored in the second memory apparatus 18. It can furthermore clearly be seen that the curve according to the invention has a much larger voltage/time integral than the curve in accordance with the prior art.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A circuit arrangement for starting a discharge lamp, comprising:

a first and a second input terminal for connecting an input voltage;

an inverter, which has an input and an output, the input being coupled to the first and the second input terminal and the output being coupled to a first and a second output terminal for connecting the discharge lamp;

a resonant circuit including a resonant inductor, which is coupled between the output of the inverter and the first output terminal;

a regulating apparatus for regulating the frequency of the signal provided at the inverter output; and a current measuring apparatus, which is arranged so as to measure a current which is correlated with the current in the resonant circuit, wherein the regulating apparatus is adapted to regulate the frequency at the output of the inverter as a function of the measured current, and wherein the regulating apparatus comprises:

a first memory apparatus for storing a value which has been correlated with a maximum ($I_{max}$) of the current in the resonant circuit;

a comparison apparatus for comparing a value ($I_{act}(f)$), which has been correlated with the current in the resonant circuit and which results given the instantaneous frequency of the signal at the output of the inverter, with the maximum ($I_{max}$) stored in the first memory apparatus; and a writing apparatus for the case in which the value ($I_{act}(f)$), which has been correlated with the current in the resonant circuit and which results given the instantaneous frequency of the signal at the output of the inverter, is greater than the previously input maximum ($I_{max}$), to imput this value ($I_{act}(f)$) into the first memory apparatus.

2. The circuit arrangement as claimed in claim 1, further comprising a voltage transformer, which is coupled between the first and the second input terminal and the input of the inverter, the current measuring apparatus being in the form of a shunt and being arranged in the voltage transformer, and the voltage transformer being connected to a reference potential in such a way that the current through the shunt is correlated with the current in the resonant circuit.

3. The circuit arrangement as claimed in claim 1, wherein the regulating apparatus comprises:

a control apparatus for controlling the frequency of the signal at the output of the inverter;

a second memory apparatus, into which a differential value ($\Delta I$) is input;

the comparison apparatus being adapted to form the difference ($I_{Diff}(f)$) between the maximum ($I_{max}$) stored in the first memory apparatus and the value ($I_{act}(f)$) which results given the instantaneous frequency of the signal at the output of the inverter and to compare this with the differential value ($\Delta I$) input in the second memory apparatus, the control apparatus being adapted to alter in one direction, i.e. to lower or to raise, the frequency of the signal at the output of the inverter until the difference ($I_{Diff}(f)$) is greater than or greater than or equal to the input differential value ($\Delta I$), and then to alter said frequency again in the reverse direction, i.e. to raise it or to lower it, until the difference ($I_{Diff}(f)$) is again greater than or greater than or equal to the input differential value ($\Delta I$).

4. The circuit arrangement as claimed in claim 3, wherein the differential value ($\Delta I$) is a maximum of 50% of the maximum ($I_{max}$).

5. The circuit arrangement as claimed in claim 1, wherein the frequency at the output of the inverter is altered in step changes of at most 1 kHz.

6. The circuit arrangement as claimed in claim 1, wherein the time constant of the regulating apparatus is at most 5 ms.

7. A method for starting a discharge lamp using a circuit arrangement comprising a first and a second input terminal for connecting an input voltage, an inverter which has an input and an output, the input being coupled to the first and the second input terminal, and the output being coupled to a first and a second output terminal for connecting the discharge lamp, a resonant inductor, which is coupled between the output of the inverter and the first output terminal, a resonant circuit, which comprises the resonant inductor, and a regulating apparatus for regulating the frequency of the signal provided at the inverter output;

wherein the method comprises the steps of:

measurement of a current ($I_{act}(f)$), which has been correlated with the current in the resonant circuit;

regulation of the frequency at the output of the inverter as a function of the measured current ($I_{act}(f)$); and further comprising the steps of:

a) measurement of the instantaneous current value ($I_{act}(f)$) which results given the instantaneous frequency;

b) determination of a difference ($I_{Diff}$) between a stored current value ($I_{max}$), which corresponds to a present maximum of the current value, and the instantaneous current value ($I_{act}(f)$); and c) comparison of the instantaneous current value ($I_{act}(f)$) with the current value ($I_{max}$) stored as the present maximum:

c1) if the instantaneous current value ($I_{act}(f)$) is greater than the stored current value $I_{max}$): storing of the instantaneous current value ($I_{act}(f)$) instead of the previously stored current value ($I_{max}$);

c2) if the instantaneous current value is less than the stored current value: cancelling of the instantaneous current value.

8. The method as claimed in claim 7, wherein step b) further comprises:

b1) if the regulation runs straight from higher frequencies to lower frequencies:

b11) if the difference ($I_{Diff}$) is less than a stored differential value ($\Delta I$):

lowering of the instantaneous frequency by a predeterminable frequency value ($\Delta f$);

b12) if the difference ($I_{Diff}$) is greater than or equal to a stored differential value ($\Delta I$):

raising of the instantaneous frequency by a predeterminable frequency value ($\Delta f$);

b2) if the regulation runs straight from lower frequencies to higher frequencies:

b21) if the difference ($I_{Diff}$) is less than a stored differential value ($\Delta I$):

raising of the instantaneous frequency by a predeterminable frequency value ($\Delta f$);

b22) if the difference ($I_{Diff}$) is greater than or equal to a stored differential value ($\Delta I$): lowering of the instantaneous frequency by a predeterminable frequency value ($\Delta f$); and wherein the method further comprises the step of:

d) repetition of steps a), b) and c) up until starting of the discharge lamp.

9. The method as claimed in claim 8, wherein, instead of the respective current values, voltage values correlated therewith are measured, evaluated and stored.

10. The method as claimed in claim 7, wherein, instead of the respective current values, voltage values correlated therewith are measured, evaluated and stored.

11. The circuit arrangement as claim 1, wherein the frequency at the output of the inverter is altered in step changes of at most 50 Hz.

12. The circuit arrangement as claimed in claim 1, wherein the time constant of the regulating apparatus is at most 2 ms.

* * * * *